United States Patent [19]

Föll et al.

[11] Patent Number: 4,508,750

[45] Date of Patent: Apr. 2, 1985

[54] PROCESS FOR CROSSLINKING LACQUERS WHICH ARE BASED ON PLASTICS AND HAVE BEEN APPLIED TO BASE MATERIALS

[75] Inventors: Eberhard Föll, Nehren; Peter Holl; Helmut Vetter, both of Tübingen, all of Fed. Rep. of Germany

[73] Assignee: 501 Polymer-Physik GmbH & Co., Fed. Rep. of Germany

[21] Appl. No.: 239,039

[22] Filed: Feb. 27, 1981

[30] Foreign Application Priority Data

Mar. 21, 1980 [DE] Fed. Rep. of Germany ..... 3010821

[51] Int. Cl.[3] ..... B05D 3/06

[52] U.S. Cl. ..... 427/44; 250/492.1; 427/54.1; 427/294; 427/421

[58] Field of Search ..... 427/44, 294, 54.1, 421; 250/492 B, 492 R, 527; 34/1

[56] References Cited

U.S. PATENT DOCUMENTS

| | | | |
|---|---|---|---|
| 3,676,673 | 7/1972 | Coleman | 250/52 |
| 3,807,052 | 4/1974 | Troue | 250/492 |
| 4,118,873 | 10/1978 | Rothchild | 250/492 |
| 4,135,098 | 1/1979 | Troue | 250/492 |
| 4,246,315 | 1/1981 | Kopp et al. | 427/44 |

*Primary Examiner*—S. L. Childs

*Attorney, Agent, or Firm*—Larson and Taylor

[57] ABSTRACT

As in the case of the irradiation of plane materials, the production of an inert atmosphere for the radiation-curable coating plays a decisive role with regard to the operating costs and the quality of the resulting product in the case of the curing of shaped parts. The present invention shows that the production of an inert atmosphere with the aid of a vacuum/inert gas lock with subsequent feeding through the lock into a radiation chamber constitutes an inexpensive means of producing an inert atmosphere for shaped parts, since flushing of the radiation chamber 8 to 10 times before each irradiation operation, as was necessary in the past, is dispensed with.

5 Claims, 3 Drawing Figures

Figure 1:
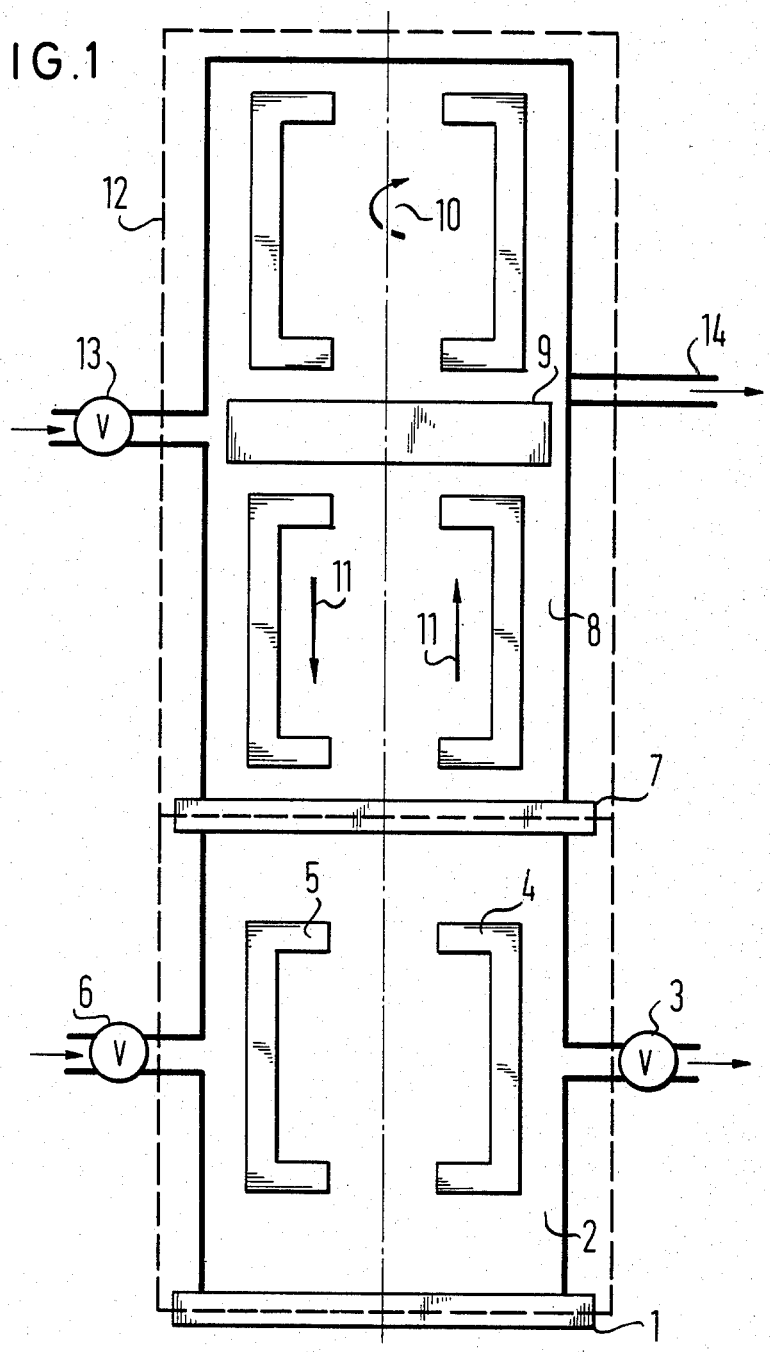

PROCESS FOR CROSSLINKING LACQUERS WHICH ARE BASED ON PLASTICS AND HAVE BEEN APPLIED TO BASE MATERIALS

The present invention relates to a process and a device for crosslinking lacquers, which are based on plastics and have been applied to base materials, by means of ionizing radiation, in particular electron radiation, the articles to be irradiated being in an inert gas atmosphere.

Processes for curing or crosslinking coating materials, which are based on plastics, with the aid of ionizing radiation, for example electron radiation, are becoming increasingly important since the lacquers used are preferably solvent-free systems or systems with only a low solvent content and relatively little energy has to be expended for crosslinking, which proceeds at room temperature. The crosslinked coatings have very good physical properties, such as high resistance to abrasion, stability to solvents and the like. Devices which nowadays work from roll to roll are distinguished by high productivity coupled with small space requirements.

In the case of the current installations for the curing of surfaces by electron radiation, the object is usually blanketed with a so-called blanketing gas in order to exclude oxygen molecules. In the main, post-purified nitrogen or a stoichiometric combustion gas which is free from oxygen is used for this purpose. This is necessary because the free radicals produced in the lacquer by the ionizing radiation react more rapidly with atmospheric oxygen than with unsaturated carbon-carbon bonds. The reaction between atmospheric oxygen and free radicals gives a stable compound, this is to say no chain propagation takes place at this point and only slight crosslinking occurs, the polymer at the surface having a relatively low molecular weight. The surface is then not scratch-resistant. A very thin film can be wiped off with solvent.

In the case of surfaces, to be cured, of lacquer-coated parts of simple shape, such as, for example, doors, sheets or material in web form from roll to roll, atmospheric oxygen is excluded by suitable introduction of nitrogen of high purity into the radiation chamber. It has been found that a counter-current flow of gas before and after the curing zone, taking into account the narrow inlet and outlet gap for the film or sheet material, is adequate.

Processes of this type are therefore just still justifiable, with regard to the expenditure on technology and the costs, only in the case of flat parts, such as sheets, doors and material from roll to roll, especially since—in particular in the case of material in web form—considerable amounts of inert gas can be saved by suitable constructions of the radiation chamber.

The provision of an inert gas atmosphere for complex shaped articles, such as vehicle dashboards, lids, closures, boxes, bumpers, tubes, rims and all hollow bodies in general, on the other hand, presents enormous difficulties, since despite the fact that the gas is replaced several times by flushing in the radiation chamber, residual oxygen diffuses out of the orifices and, thus, flawless flushing with blanketing gas is enormously expensive and time-consuming or, in many cases, even impossible. In this context, it must be taken into account that, with a large amount of gas, the gas flowing in should have as low a velocity as possible in order to prevent suction—and thus air flowing into the radiation chamber. Moreover, provision must be made for unhindered outflow of gas from the radiation chamber, without back-flow of air. According to the invention, only flushing with inert gas in an amount of 8 to 15 times the volume of the chamber suffices. In order to save inert gas, therefore, the radiation chamber is largely matched to the contours of the part to be irradiated, where the parts of a series are all the same, and, nevertheless, even with an irradiation installation of this type the costs for inert gas consumption are the highest operating costs.

The object of the invention is, therefore, to provide a process and a device which do not have the disadvantages described above, that is to say which, in particular, make it possible to lower the consumption of inert gas to a minimum.

According to the invention, this object is achieved by arranging a vacuum/inert gas lock in front of the radiation chamber, this lock being evacuated after the article is introduced and flooded with inert gas to normal pressure. The article then passes through a lock gate into the radiation chamber, in which there is an inert gas atmosphere under normal pressure.

The invention thus relates to a process for crosslinking lacquers, which are based on plastics and have been applied to base materials, by means of ionizing radiation, in particular electron radiation, in an inert gas atmosphere, which is intended to prevent the curing reaction being discontinued as a result of the lacquer reacting with oxygen, which process is characterized in that before the article which is to be irradiated and has been provided with a radiation-curable coating is introduced into the radiation chamber filled with inert gas under normal pressure, the said article is introduced through the lock gate into a vacuum/inert gas lock arranged directly in front of the radiation chamber, this lock is evacuated and flooded with inert gas to normal pressure, and the article is introduced from the lock through the lock gate into the radiation chamber, irradiated and, after irradiation, transferred back into the vacuum/inert gas lock filled with inert gas and, after one lock gate has been closed the other lock gate is opened and the article is removed, and also to a device for carrying out this process, which device essentially consists of a radiation chamber, which can be filled with inert gas, and a source for ionizing radiation and is characterized in that a vacuum/inert gas lock is arranged directly in front of the radiation chamber and optionally is additionally provided with spray devices for applying the coating which is curable by irradiation.

Thus, according to the invention, the coated part is introduced into a vacuum/inert gas lock and the chamber is closed, evacuated to a pressure of 1 mbar, corresponding to a residual oxygen content of 200 ppm (20 ppm under 0.1 mm Hg), and then flooded with inert gas, for example nitrogen, to normal pressure. The article, for which an inert atmosphere has been provided, now passes through a lock gate into the radiation chamber which is under normal pressure and is likewise filled with inert gas. In this chamber the lacquer coating on the shaped article is cured by irradiation. The shaped article can be twisted and turned, depending on its surface structure, in the radiation field, so that all lacquer-coated surfaces can be cured. In the case of discontinuous operation, removal of the article through the lock is effected through the same vacuum/inert gas lock again, the pumping process for the inert gas flooded into this lock being dispensed with. The cured part can be removed from the vacuum chamber as soon as the lock gate between the vacuum/inert gas lock and the radiation chamber has been closed. Preferably, however, in order to achieve optimum utilization of the lock process, the removal of a part from the lock and the introduction of a part into the lock are combined with one another, so that as high as possible a throughput rate can be achieved.

Further embodiments according to the invention consist in the articles passing semi-continuously in one direction or being operated in two-way operation, in which case, however, 2 vacuum/inert gas locks must be used, that is to say one vacuum/inert gas lock is located, for example, in front of the radiation chamber and the other is located behind the radiation chamber.

Tests have also shown that when the lacquers available today are used the formation of blisters due to chemicals of low vapor pressure and dissolved gases in the lacquer escaping has no adverse effect on the development of the lacquer surface. After the vacuum chamber is aerated, for example with nitrogen, the surface originally obtained by the coating process forms again immediately.

The same also applies in the case of primer coating of parts made of plastics reinforced with glass fibers, which, as is known, do not possess an entirely closed surface and therefore can be provided with a primer coating produced by cold radiation curing.

The intermediate process of evacuation of the coated part has the additional advantage that it effects partial removal of oxygen from the lacquer, since some of the oxygen dissolved in the lacquer is pumped out and thus is no longer available for saturating free radicals. A higher crosslinking density results from this.

Furthermore, the incorporation of oxygen in the lacquer coating and the adsorption of oxygen on the lacquer coating can be prevented by running the coating process, for example spraying or coating or rolling of the lacquer, in a chamber flooded with inert gas. In the case of spraying, a further factor is that, of course, an inert gas can be used in place of air as the spray gas for atomizing the lacquer.

One variant according to the invention consists in running even the spray process in the vacuum/inert gas lock flooded with inert gas; of course, in this case also nitrogen or inert gas is used as the pressure gas for the spray process.

According to the invention, sources of radiation which can be employed are all sources of radiation known to those skilled in the art, in combination with the radiation-curable polymer systems intended for these, for example UV and electron radiation sources. Preferably, the pastes, after they have been applied, are cured cold by irradiation with electrons, preferably by means of electrons with an energy of between 140 and 250 keV, and in particular with electrons with an energy of 150 keV.

In electron radiation curing, electrons are released in vacuo from a hot cathode by applying the accelerating high voltage, accelerated and fanned out in a deflecting system. After the electrons have passed through a thin metal foil, they can act on the object. Since X-ray radiation is produced when the electrons are braked, the electron accelerator and also the inlet and outlet to the installation are screened with sheet lead.

When employing electron radiation, it is particularly important that the radiation chamber is not designed for vacuum, which in conjunction with the electron outlet window would lead to difficulties. This is because, if vacuum pumps were present in the radiation chamber the window foil would no longer fit sufficiently against the cooling and supporting grid and would become too hot.

The radiation-curable or radiation-crosslinkable coatings preferably employed according to the invention are radiation-curable acrylate prepolymers, optionally in a mixture with radiation-curable acrylate monomers. In this context, the term radiation-curable is understood as meaning that the substances are radiation-polymerizable and/or radiation-crosslinkable. The radiation-curable acrylate prepolymers preferably employed include the prepolymers curable by means of UV radiation and electron radiation from the group comprising the polyester acrylates, the polyurethane acrylates, the polyether acrylates, the acrylate/acrylate copolymers and the epoxy acrylates.

The viscosity of the polymers and prepolymers employed can be varied by adding radiation-curable monomers or small amounts of solvent.

The radiation-curable polymers, prepolymers and/or monomers and the processes for radiation curing are known to those skilled in the art, for example from the article by A. Rosenberg "Oberflächenbeschichtungen härten mit Elektronenstrahlung" ("Surface Coatings Cure with Electron Radiation") (Maschinenmarkt, Würzburg (1978) page 1249 et seq.) and the article by Dr. K. Fuhr "Die Strahlungstrocknung von Grundierungen and Lacken auf Holz und Holzwerkstoffen" ("Radiation Drying of Primer Coatings and Lacquers on Wood and Wood Materials") (Deutsche Farbenzeitschrift No. 6+7 (1977) pages 257–264). Prepolymer systems of this type are marketed, for example, by Messrs. UCB Chemie GmbH.

Figure 2:
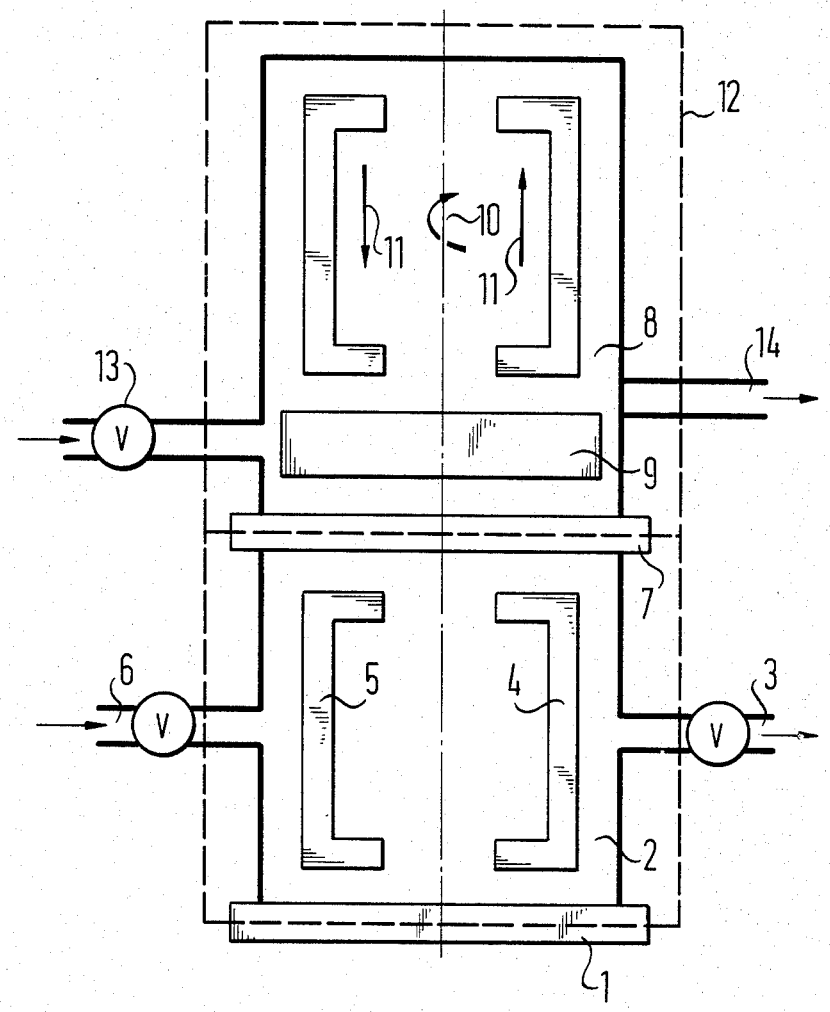
Figure 3:
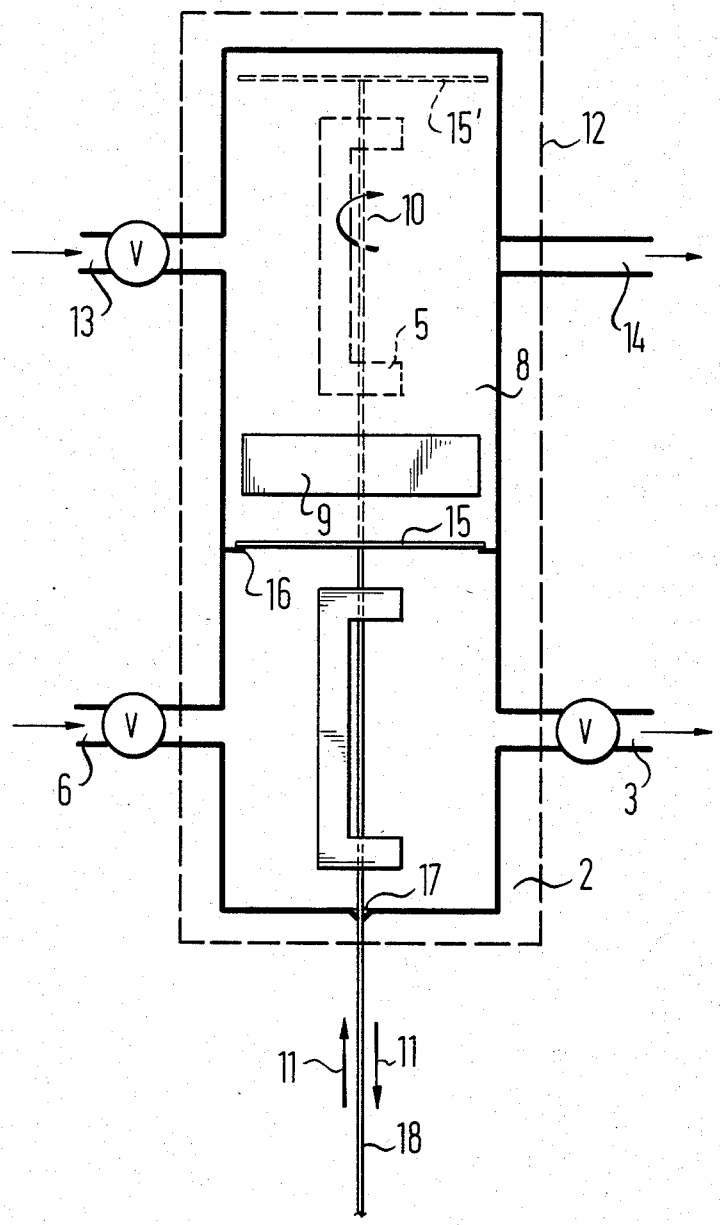

In the text which follows the invention is illustrated with the aid of examples 1 to 3, in combination with FIGS. 1 to 3, which represent embodiments particularly preferred according to the invention, without, however, restricting it thereto. All of the details which are not mentioned in the description and the examples but are evident from the drawings also constitute part of the disclosure of the invention.

FIGS. 1 to 3 show a schematic representation of devices according to the invention for carrying out the process according to the invention.

The reference numbers in FIGS. 1 to 3 have the following meaning:

1: Lock gate with integral X-ray screening
2: Vacuum/inert gas lock
3: Vacuum pump connection
4: Upper side of the object
5: Underside of the object
6: Inert gas inlet
7: Lock gate to the radiation chamber with integral X-ray radiation screening
8: Radiation chamber
9: Source of radiation
10. Rotary device for the article to be irradiated
11: Direction of movement of the article to be irradiated
12: X-ray radiation screen
13: Inert gas filling
14: Pressure release of the vacuum/inert gas lock
15: Lock gate which can be moved into the radiation chamber 8
15': Movable lock gate 15 in the "end" position of the first irradiation process 16: Seal between the vacuum/inert gas lock and the radiation chamber 17: Seal for the moving device for the object and the lock gate between the vacuum/inert gas lock and the radiation chamber 18: Guide for the object table and the lock gate between the vacuum/inert gas lock and the radiation chamber.

EXAMPLE 1

This example uses a device such as is shown schematically in FIG. 1.

The part, for example a bumper for automobiles, which is sprayed under inert gas, using inert gas as the pressure gas, is placed, through the lock gate 1, into the vacuum/inert gas lock 2. After closing the lock gate 1, the lock is evacuated to a pressure of 1 mbar or below and then flooded with inert gas to normal pressure. The lock gate 7 is opened, the part is transported into the radiation chamber 8, the lock gate 7 is closed, the part is passed through underneath the source of radiation, turned and passed through beneath the source of radiation again, the lock gate 7 is opened and the first part is passed through the gate into the vacuum/inert gas lock 2; at this point the 2nd part, which has already been fed into the lock during the radiation, is brought, in exchange, from the vacuum/inert gas lock 2 into the radiation chamber 8. The 1st part is removed from the lock and, at this time, the 3rd part is already fed into the lock again, for the period for which the 2nd part is being irradiated.

The total consumption of inert gas is restricted to the production of an inert gas atmosphere in the radiation chamber 8 by flushing the radiation chamber 8 with inert gas in an amount which corresponds to about 10 to 20 times the volume of the radiation chamber, and the flushing of the vacuum/inert gas lock 2 after each operation of the lock.

With this procedure, that is to say using a vacuum/inert gas lock 2 and a twin radiation chamber 8, the following cycle times result:

| Time | Vacuum/inert gas lock | Radiation chamber |
|---|---|---|
| | Feed in/remove | Irradiate upper side 1st part |
| 10 seconds | 1 part in each case | Irradiate the underside 2nd part |
| | Pump/flood with $N_2$ | |
| 5 seconds | Operate lock and so on | Turn part |

EXAMPLE 2

This example uses a device such as is shown schematically in FIG. 2.

The pallet, which holds several vehicle dashboards, comes from the automatic spray equipment, where spraying has been carried out under an inert gas atmosphere using inert gas as the pressure gas, through the lock gate 1 into the vacuum/inert gas lock 2. Lock gate 1 is closed. The lock is evacuated to $10^{-2}$ mbar and then flooded with inert gas to normal pressure, lock gate 7 is opened and the lacquer-coated parts are passed through beneath the source of radiation 9 in the radiation chamber 8 at a speed such that the lacquer is crosslinked with the necessary dose. Lock gate 7 is closed, a 2nd part is fed into the lock, the 1st part is turned and, after the pumping and flooding operation, lock gate 7 is opened again and the 2nd part is irradiated from above and the 1st part is irradiated from below. The 2nd part is now in the vacuum/inert gas lock 2 and the 1st part is in the radiation chamber 8. The 2nd part is turned, the 1st part is removed from the lock and, at the same time, the 3rd part is introduced into the lock.

In this case also, the consumption of inert gas is restricted to the single production of an inert atmosphere in the radiation chamber 8 and the further consumption is restricted to the flooding of the vacuum/inert gas lock 2 in each case after the parts have been introduced into the lock or removed from the lock.

With this procedure, that is to say using a vacuum/inert gas lock 2 and a single radiation chamber 8, the following cycle times result:

| Time | Vacuum/inert gas lock | Radiation chamber |
|---|---|---|
| | Feed in/remove | Turn part |
| 10 seconds | 1 part in each case | Irradiate the end faces if necessary |
| | Pump/flood with $N_2$ | |
| 15 seconds | Operate the lock | Irradiate upper side of 1st part Irradiate underside of 2nd part |
| | and so on | |

EXAMPLE 3

This example uses a device such as is shown schematically in FIG. 3, in which the pallet for the goods to be irradiated and the lock gate 15 are firmly connected to one another between the vacuum/inert gas lock 2 and the radiation chamber 8.

The part, which has been coated under an inert gas atmosphere and using inert gas as the pressure gas, is introduced from above into the vacuum/inert gas lock 2. The lid (not shown in FIG. 3) to the vacuum/inert gas lock is closed, the vacuum/inert gas lock is evacuated to a vacuum of between 1 mbar and $1\times10^{-2}$ mbar, the vacuum/inert gas lock is flooded with inert gas to normal pressure, the lock gate 15 and the object 4 are moved with the aid of the rod 18 beneath the source of radiation 9 at a speed with corresponds to the dose to be applied, in the end position 15' the object is turned with the aid of the rod 18 and fed back beneath the source of electron radiation, the rear side being irradiated, into the vacuum/inert gas lock 2 again. The object is removed from the vacuum/inert gas lock, the second object is placed in the lock and the evacuation operation starts afresh again.

Although the invention has been explained taking bumpers as an example, it also relates to small parts which can be collected together on pallets. For example, vehicle dashboards and rims (disk wheels) are irradiated analogously to the bumpers. Tubes and profiles with long lengths are fed analogously through the lock gates into the vacuum/inert gas lock and the radiation chamber, and, to reduce the volumes, tubes can be used for the chamber walls.

We claim:

1. A method of cross-linking a lacquer coating applied to an article, said lacquer being of the type curable by ionizing radiation in an inert atmosphere comprising:

(a) providing an article in a gas lock chamber, said chamber comprising a gate lock;

(b) evacuating said gas lock chamber;

(c) flooding inert gas into said gas lock chamber to normal pressure;

(d) opening said lock gate;

(e) moving said article directly from said gas lock chamber through said lock gate and into an irradiation chamber, said article bearing a coating of said lacquer, said irradiation chamber containing an inert gas atmosphere at normal pressure;

(f) irradiating the coated article with ionizing radiation in said radiation chamber to cross link said lacquer;

(g) moving the irradiated article back through said lock gate directly into said gas lock chamber, said gas lock chamber containing inert gas at normal pressure;

(h) closing said lock gate; and (i) removing said article from said gas lock chamber.

2. A method according to claim 1 wherein said lacquer coating is provided by spraying said lacquer on said article when said article is in said gas lock chamber and after said flooding of said gas lock chamber with inert gas.

3. A method according to claim 1 wherein said inert gas comprises nitrogen.

4. A method according to claim 1 wherein said irradiating is effected with electron radiation of 150 to 400 keV.

5. A method according to any one of claims 1–4 wherein said gas lock chamber is evacuated to a pressure of not greater than one mbar prior to said flooding with said inert gas.

* * * * *